US008794113B2

(12) United States Patent
Maury

(10) Patent No.: US 8,794,113 B2
(45) Date of Patent: Aug. 5, 2014

(54) RF CONNECTOR TORQUE RING AND TORQUE NUT SYSTEMS

(75) Inventor: Marc A. Maury, Claremont, CA (US)

(73) Assignee: Maury Microwave, Inc., Ontario, CA (US)

( * ) Notice: Subject to any disclaimer, the term of this patent is extended or adjusted under 35 U.S.C. 154(b) by 185 days.

(21) Appl. No.: 13/303,132

(22) Filed: Nov. 22, 2011

(65) Prior Publication Data

US 2013/0125716 A1 May 23, 2013

(51) Int. Cl.
*B25B 23/155* (2006.01)

(52) U.S. Cl.
USPC ..... 81/472

(58) Field of Classification Search
USPC ..... 81/467, 473, 476, 177.6, 177.7
See application file for complete search history.

(56) References Cited

U.S. PATENT DOCUMENTS

| | | | | |
|---|---|---|---|---|
| 2,157,574 | A | 11/1937 | Siesel | |
| 2,378,956 | A | 6/1945 | Thorner | |
| 2,690,090 | A | 9/1954 | Pedersen | |
| 2,734,412 | A | 2/1956 | Orner | |
| 2,930,212 | A * | 3/1960 | Walterscheid-Muller et al. | 464/37 |
| 2,977,832 | A | 4/1961 | Bless | |
| 4,552,042 | A * | 11/1985 | Beymer | 81/476 |
| 4,575,274 | A | 3/1986 | Hayward | |
| 5,297,458 | A | 3/1994 | Smith et al. | |
| 5,497,682 | A | 3/1996 | Hsu | |
| 5,662,012 | A | 9/1997 | Grabovac | |
| 5,813,298 | A | 9/1998 | Beattie | |
| 5,857,816 | A | 1/1999 | Assmundson | |
| 5,953,966 | A | 9/1999 | Spirer | |
| 5,974,919 | A | 11/1999 | Habele | |
| 6,148,694 | A | 11/2000 | Spirer | |
| 6,840,138 | B2 | 1/2005 | Graffin | |
| 6,898,998 | B2 * | 5/2005 | Shyu | 81/63.1 |
| 7,011,001 | B2 | 3/2006 | Knox et al. | |
| 2005/0072277 | A1 | 4/2005 | Knox et al. | |
| 2006/0043809 | A1 | 3/2006 | Lau et al. | |

FOREIGN PATENT DOCUMENTS

JP 2007213864 8/2007

OTHER PUBLICATIONS

Notification of Transmittal of the International Search Report and the Written Opinion of the International Searching Authority, or the Declaration, dated Feb. 6, 2013.
Data Sheet re 3.5 mm "Metrology Grade" Sliding Termination Set, Model 8037C, Maury Microwave, 2002 (1 page).
Unpublished Drawing package re Pull Back feature for sliding termination, Maury Microwave, 6 pages, pre 2002.
Data Sheet re "Metrology Grade"—Sliding Termination Set, Model 8034C, 1987, 2 pages.
"Microwave Coaxial Connector Technology: A Continuing Evolution," Mario A. Maury, Jr., Maury Microwave Corporation, Application Note 5A-21, 2005, originally published in the Microwave Journal 1990 State of the Art Reference, 1990, Updated Dec. 2005.

* cited by examiner

*Primary Examiner* — Lee D Wilson
*Assistant Examiner* — Melanie Alexander
(74) *Attorney, Agent, or Firm* — Larry K. Roberts

(57) ABSTRACT

Exemplary embodiments of a torque ring or nut system for use on or with RF and microwave male/female paired coaxial connectors, to apply a pre-set torque value to the mated coaxial connector pair. The torque system includes an inner ring structure and an outer ring structure configured for rotation relative to each other. Rotation of the outer ring structure applies a torque to the inner ring structure.

29 Claims, 9 Drawing Sheets

FIG. 2A
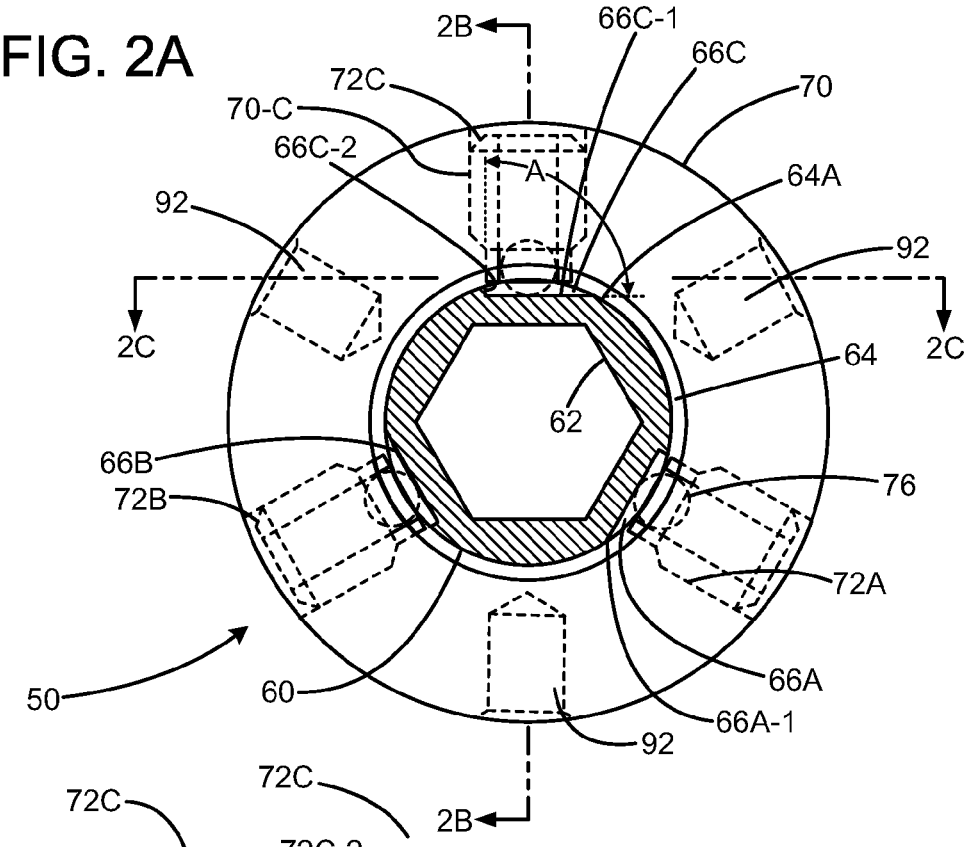
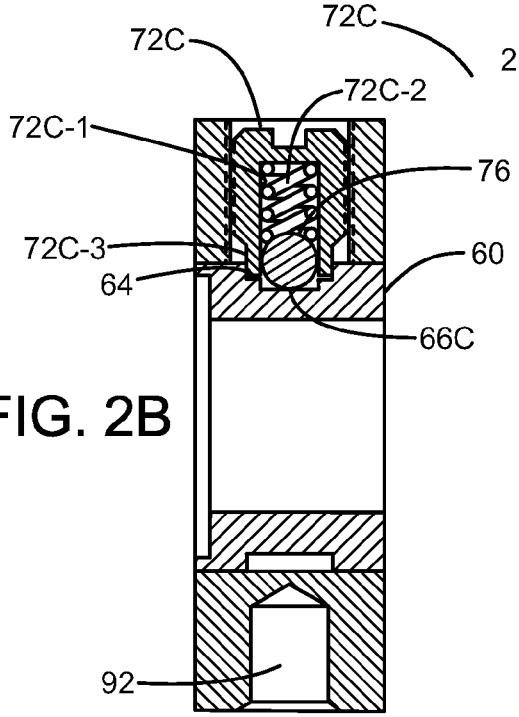
FIG. 2B
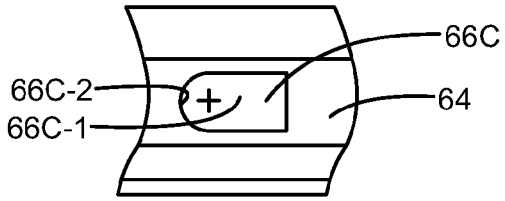
FIG. 2C

RF CONNECTOR TORQUE RING AND TORQUE NUT SYSTEMS

BACKGROUND

This invention relates to RF connectors. Proper torque must be applied to a mated pair of coaxial connectors to ensure consistent and repeatable tests of coaxial devices under test and this is especially true in the case of calibration of any test instrument such as network analyzers or other test instrumentation having coaxial test ports.

The sex of coaxial connectors is conventionally identified by the configuration of the inner conductor center contacts. If a connector has a pin then it is considered a male connector; if it has a socket then it is considered a female connector. The outer conductor of the female connector has male threads and the male connector has a connector nut with female threads, configured to engage the male threads on the female connector body. This rule will almost always apply except in the case where the connectors are hermaphrodite or a special configuration where the sex is reversed to accommodate polarization.

Singular solid plastic or metal spin rings have been used, with a female hex feature in the middle, corresponding to the hex nut size, a typical size being approximately 5/16 inch thick and having an outside diameter of ¾ inch approximate, with external features (bumps, hex, knurl, etc.) to assist in gripping or rotating to loosen or tighten the male coaxial connector to a mating female connector. Some of these spin rings have a slot to allow clearance for a 0.086 or 0.141 diameter coaxial cable when the spin ring is introduced from the rear. This device does not apply a pre-set torque to the mated pair of connectors when coupled and tightened. By its nature, the device does not provide electrical measurement repeatability from mating to mating due to the inconsistent pressure applied at the mating interface plane of the connectors.

Commercially available torque wrenches have an open end wrench of the appropriate size to mate with the hex nut on the applicable connector and a handle typically 5-6 inches long and has a pre-set torque value. This handle slips and disengages when the pre-set torque value is reached, ensuring that the connected pair of connectors will not exceed the torque specifications for the applicable mated pair.

Typically a spin ring is left on the connector during test and cannot be removed to allow the use of a torque wrench to achieve the torque specification. Conversely the spin ring (in most configurations of connectors) cannot be used if it is necessary to use the torque wrench to apply torque to the coupled connectors.

In the case of the hex coupling nuts that are permanently fastened to the male or hermaphrodite (sexless) coaxial connectors there are no provisions built into the nuts to apply the correct torque to the coupled pair of connectors.

BRIEF DESCRIPTION OF THE DRAWINGS

Features and advantages of the disclosure will readily be appreciated by persons skilled in the art from the following detailed description when read in conjunction with the drawing wherein:

FIGS. 2A, 2B and 2C illustrate an exemplary embodiment of a torque ring system including an inner ring structure and an outer ring structure.

DETAILED DESCRIPTION

Figure 1A:
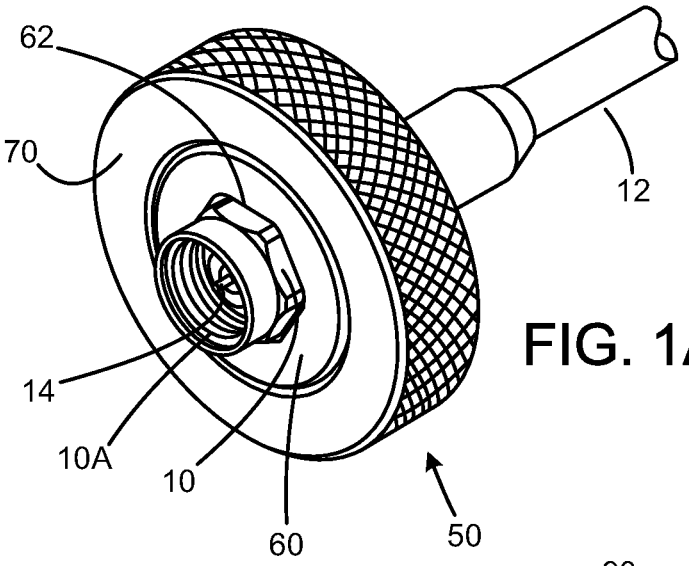
FIG. 1A is an isometric view of an exemplary embodiment of a torque ring system in place on an RF male connector.

In the following detailed description and in the several figures of the drawing, like elements are identified with like reference numerals. The figures are not to scale, and relative feature sizes may be exaggerated for illustrative purposes.

In an exemplary embodiment, a torque ring or nut system is used on or with RF and microwave male/female paired coaxial connectors, to apply a pre-set torque value to the mated coaxial connector pair. This results in significant time savings in mating and applying torque to a pair of connectors. In an exemplary embodiment, the torque ring is employed on the male coaxial connector; the mating female connector may be fixed to a device or instrument, and can be held securely by hand or by mechanical devices. An exemplary embodiment of the torque ring ("TR") system is contemplated as a removable torque system, which can be removed from the connector after use, and an exemplary embodiment of the torque nut ("TN") system is contemplated as a non-removable system, integrated with the connector structure.

Exemplary applications include 1.0, 1.85, 2.4, 2.92 and 3.5 mm connectors having a 5/16 inch hexagonal coupling nut, as well as any connector utilizing a hex nut or having a coupling nut to assist in tightening or torqueing one connector to another mating connector for the purposes of test and calibration, preferably by use of finger pressure only. Exemplary embodiments of both the TR and TN devices can be mechanically calibrated to a pre-set torque value using conventional torque calibration equipment and suitable adapters.

Figure 1B:
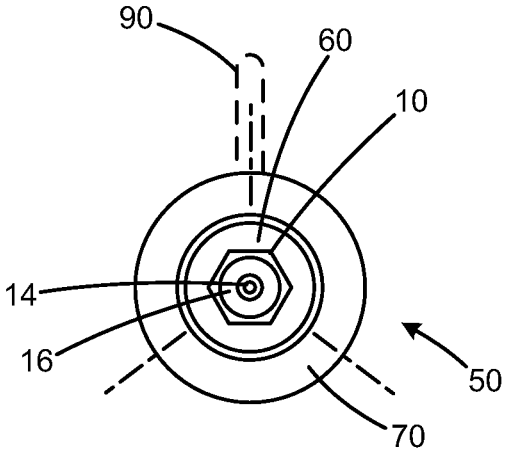
FIG. 1B is a front view of the system and RF connector of FIG. 1A.
Figure 1C:
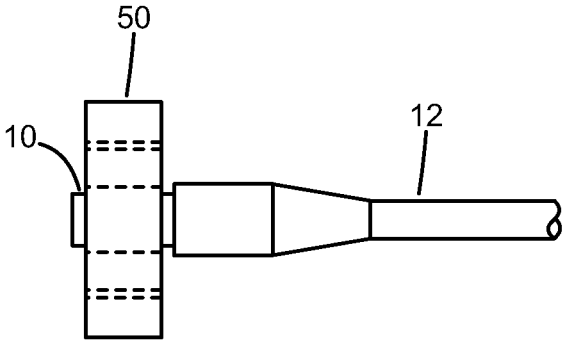
FIG. 1C is a side view of an alternate embodiment of a torque nut system and RF male connector mounted on a cable assembly.
Figure 3A:
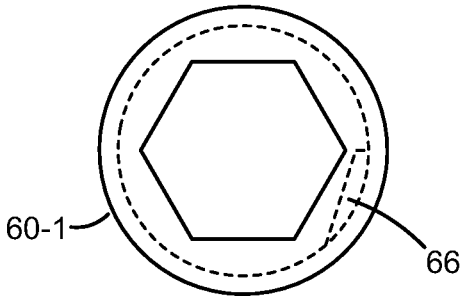
FIGS. 3A-3D illustrate different exemplary embodiments of an inner ring structure for the torque ring system.
Figure 3B:
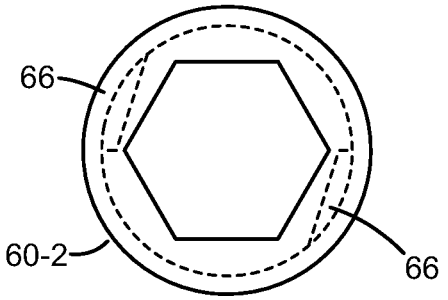
Figure 3C:
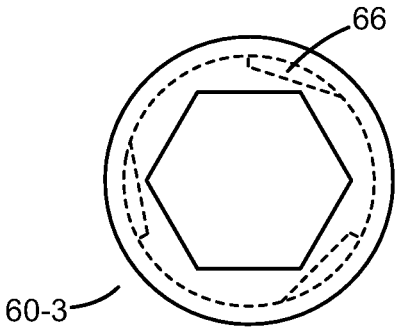
Figure 3D:
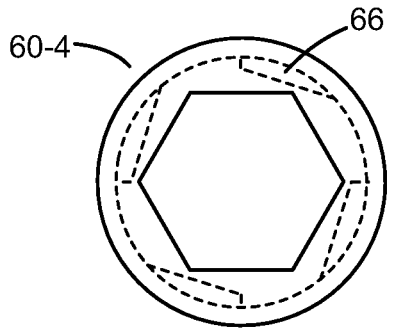

An exemplary embodiment of the invention includes an outer ring structure and an inner ring structure. FIGS. 1A-1C illustrate an exemplary embodiment of a torque ring system 50, as positioned on a male coaxial connector 10 attached to a coaxial cable 12. As is well known, the coaxial cable includes a center conductor 14, an outer conductive shield (not visible in FIG. 1A) and a dielectric sleeve 16 surrounding the center conductor and positioned between the center conductor and outer conductive shield. The connector 10 has internal threads 10A which engage outer threads on a corresponding female connector (not shown in FIG. 1A). The torque system 50 can be used to torque the threaded connection between the male connector and female connector to the desired torque specification.

The torque ring system 50, as further illustrated in FIGS. 2A-2C, includes an inner ring structure 60 and an outer ring structure 70, with the outer ring structure gripped by the user and rotated about the inner ring structure.

The inner ring structure 60 has a female configuration opening 62 formed through the center (with or without a stop surface to control depth of engagement), the size to conform closely to the connector size used on the applicable coaxial connector coupling nut to be threaded and torqued to specification. Typical connector configurations are hexagonal ("hex"), but the torque system may be adapted to other connector configurations as well. The opening 62 allows the connector nut to be fitted within the opening for use.

An exemplary embodiment of the inner ring structure 60 has a continuous groove 64 on its outer diameter having a depth suitable to receive retaining pins or set screws 72 into the groove introduced from the outer ring structure 70. The pins 72 are of a suitable diameter and quantity to allow smooth rotation of both ring structures without binding while at the same time allowing minimum end play between the inner and outer ring structures 60 and 70, i.e. the axial movement between the outer ring 70 and inner ring 60. The groove 64 has a bottom surface 64A.

The retaining pins 72 in an exemplary embodiment can be, for example, dog-point setscrews engaging a threaded bore in the outer ring.

An exemplary embodiment of the inner ring 60 has at least one indentation 66 forming a ramp surface, and in some cases, two or more symmetrical indentations or sets of indentations located on groove bottom surface 64A. FIG. 2A illustrates an exemplary embodiment of the inner ring 60 in which three indentations 66A, 66B and 66C are formed at 120 degree spacing around the periphery of the inner ring 60. Each of the indentations in an exemplary embodiment has a long surface and a short surface meeting with the long surface at an angle A, which is at least 90 degrees. For example, the indentation 66C has a short surface 66C-2 and a long surface 66C-1.

The indentations 66A, 66B, 66C in the exemplary embodiment of FIG. 2A are each configured to receive a spring loaded, hardened ball 76 introduced through the wall of the outer ring 70. The number of indentations may vary depending on the number of pins or set screws 72 utilized to reach the desired rotational torque value. The number may be as little as one to the maximum allowed by the available space on the circumference of the inner ring 60. The set screws are hollow, with an interior bore to receive a spring and the ball 76. FIG. 2B illustrates exemplary set screw 72C, with interior bore 72C-1 having spring 72C-2 and ball 76 disposed therein. The spring 72C-2 is compressed by the set screw 72C being turned on interior threads formed in the outer ring bore 70-C, with the ball coming to rest on the long surface 66A of the indentation 66. Pressure is applied to the spring-loaded ball 76 by tightening the screw 72C until the desired rotational torque value is established.

In an exemplary embodiment, maximum torque is reached when the ball travels to the edge 66A1 of the long flat surface 66A of the indentation 66 and transitions to the surface 64A of the inner ring groove or race 64 as the outer ring 70 is rotated clockwise over the fixed or stationary inner ring 60. When the ball 76 transitions to the groove surface 64A, maximum torque will be achieved and cannot be exceeded even as the outer ring continues through 360 degrees of continuous clockwise rotation. As the outer ring is rotated clockwise, the pre-loaded ball 76 will drop into the next indentation 66, with the ball being adjacent to the short vertical wall 66B of that indentation. When rotation of the outer ring is reversed to counter-clockwise motion, a higher torque value is presented by the ball trying to climb over the vertical face or short stop surface 66B of the indentation. This increased torque is then applied to the inner ring 60 and transmitted to the connector hex nut 10, allowing the user to overcome the original torque applied (in a clockwise motion), and therefore allowing the mated pair of connectors to be unthreaded and decoupled.

FIGS. 3A-3D illustrate various respective alternate embodiments of the inner ring 60-1, 60-2, 60-3 and 60-4, wherein the inner ring may include one, two, three or four indentations in the bottom surface of the groove.

Figure 4A:
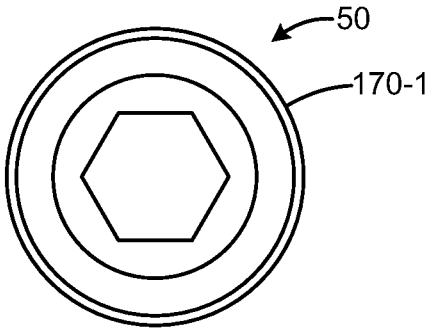
FIGS. 4A-4E illustrate different exemplary outer ring surface configurations for the outer ring structure of a torque ring system.
Figure 4B:
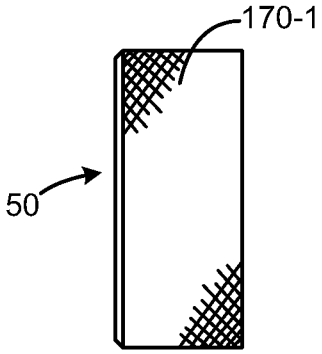
Figure 4C:
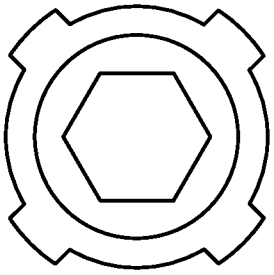
Figure 4D:
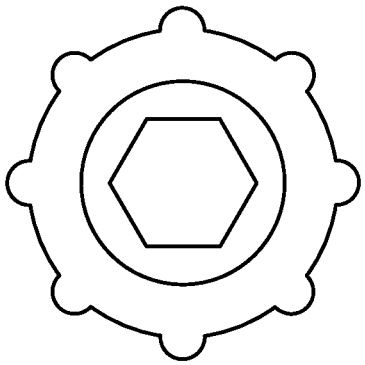
Figure 4E:
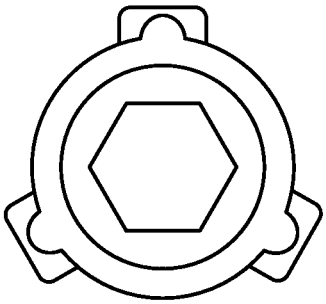

The outer circumferential surface of the outer ring 70 may have a variety of configurations, all designed to provide a non slip comfortable grip for the user as well as providing a mechanical advantage to amplify the inner ring rotation assisting it to reach its maximum torque value. For example, FIGS. 4A and 4B illustrate a torque ring system 50 in which the outer surface 170-1 of the outer ring is knurled. FIGS. 4C, 4D and 4E show alternate configurations of the outer ring with flutes or ribs protruding from the outer surface.

An exemplary embodiment of the outer ring 70 provides one or more threaded holes to receive the balls with springs on set screws, one or more, and in an exemplary embodiment, three tapped or press fit holes to accept the retaining pins. The outer ring may also be provided with one or more clearance or tapped holes to accept an auxiliary rod 90 (FIG. 1B) to assist in reaching maximum torque or breaking loose to unfasten the TR. This rod would not normally be required unless a user has inadequate hand strength to overcome the applied torque.

Tests have shown that by using rotational force it is possible to hand tighten a 0.75 inch diameter spin ring and apply 8 in/lbs. of torque. While this is possible it does require considerable hand strength to do so. By increasing the outer diameter of the ring to 1.0 inch, for example, the application of the 8 In/lbs. of torque becomes much easier and appears to be a practical solution for someone of average hand strength to apply intermittently as required by tests of this nature. Therefore, an outer diameter surface or peak diameter of an outer ring having knurls, spokes, ridges or variable shape indentations are suitable for this application.

The torque system can be calibrated prior to use to set the amount of maximum torque applied by the system. An exemplary calibration technique is analogous to a technique used to calibrate torque wrenches. A torque meter such as a Mountz Torque Tester (e.g. model LTT-2100) may be employed with suitable coaxial adapters to mate the torque ring or torque nut system to the torque tester. For example, for the torque ring system, the assembled torque ring may be inserted onto the hex shaft of the adapter mounted on the torque tester. For the torque nut system, the torque nut may be screwed onto the male threads on the adapter mounted on the torque tester. The outer ring of the system is rotated clockwise to determine the starting torque value. When the maximum torque is reached, the outer ring will continue to rotate until the ball(s) drop into the next indentation. The torque ring or torque nut will not be capable of applying any additional torque without adjusting the setscrew(s) such as 72A, 72B and 72C. To adjust the maximum torque, the setscrew(s) may be evenly turned clockwise to increase the pressure between the outer ring 70 and inner ring 60, thus increasing the radial torque that the torque ring or torque nut will apply to the torque tester when rotated clockwise. The measured torque value may be recorded, and the process of evenly turning the setscrew(s) may be repeated until the desired maximum torque pressure is achieved.

In an exemplary embodiment, the calibrated torque value may be in the range of 5 to 25 inch pounds with an accuracy of +/5%.

Figure 5A:
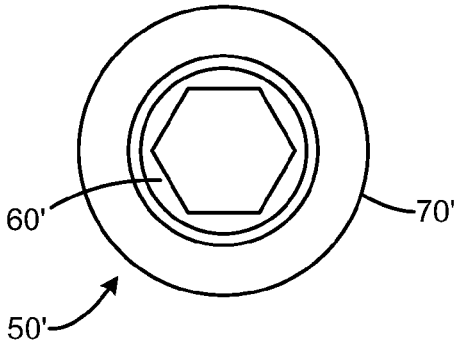
FIG. 5A is a front view of an alternate torque ring system employing an extended outer ring structure.
Figure 5B:
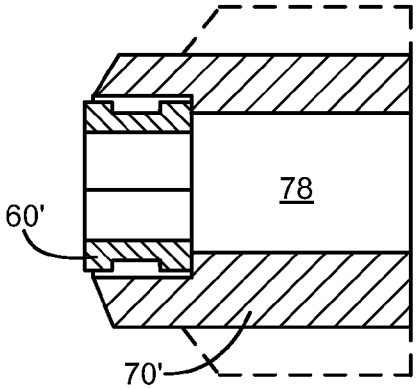
FIG. 5B is a side cross-sectional view of the torque ring system of FIG. 5A.

An alternate embodiment of the torque ring system 50' is illustrated in FIGS. 5A and 5B. This embodiment employs an extended outer ring structure 70' fitted to the inner ring 60'. The outer ring 70' has a longitudinal extent which is longer than the width of the inner ring 60', thus providing more gripping surface and facilitating use of hand strength alone to be applied to the torque ring system. The outer ring 70' includes an inner opening 78 to provide clearance for the coaxial connector body. The length of the outer ring 70' may be any convenient length, e.g., 0.75 inch or 1. Inch.

Figure 6A:
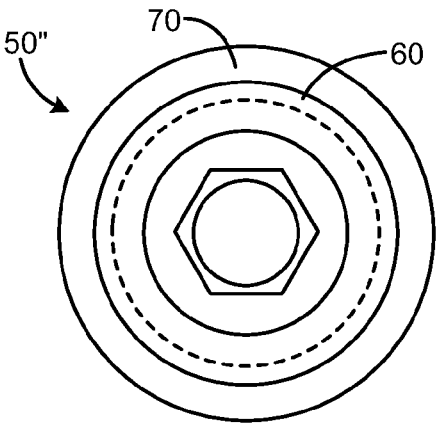
FIGS. 6A and 6B illustrate an alternate embodiment of a torque ring system with a stop surface to control depth of engagement of the connector.
Figure 6B:
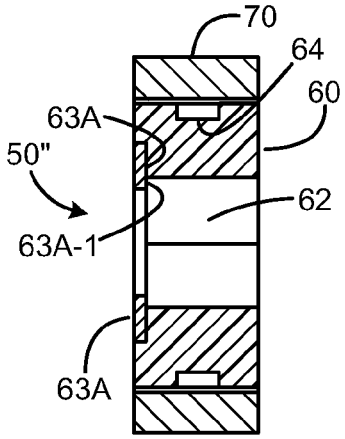

FIGS. 6A and 6B illustrate an alternate embodiment of a torque ring system 50" with a stop surface to control depth of engagement of the connector. The stop surface is provided by a thin annular ring 63A fitted into recess 63 formed in the inner ring 60. The opening in the ring 63A is of smaller diameter than the opening size of the hex opening 62 formed in the inner ring, so that the leading edge of the connector 10 will contact the interior edge 63A1 as the connector engages the torque ring system 50".

Figure 7A:
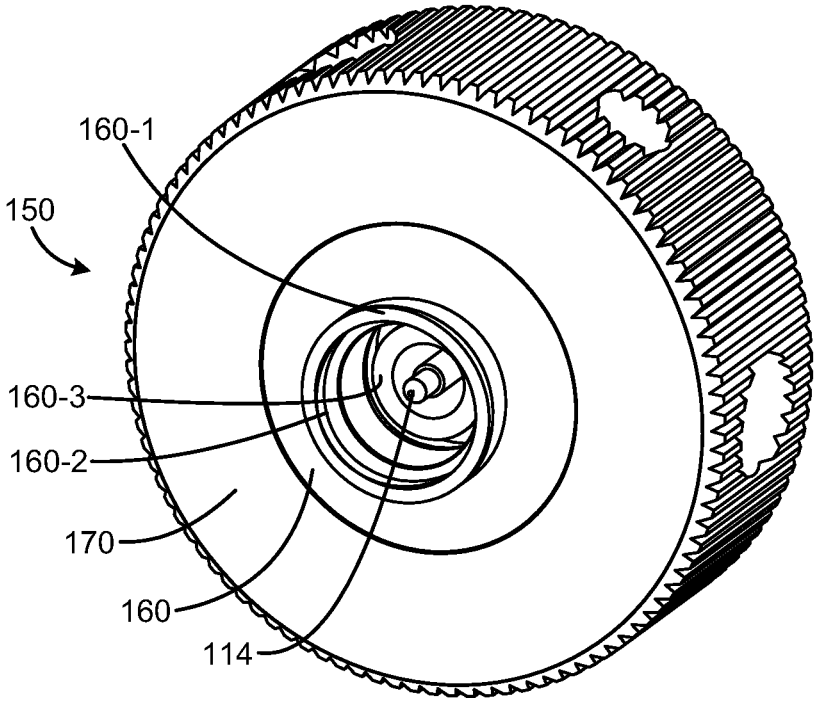
FIGS. 7A, 7B and 7C illustrate an exemplary embodiment of a torque nut system.
Figure 7C:
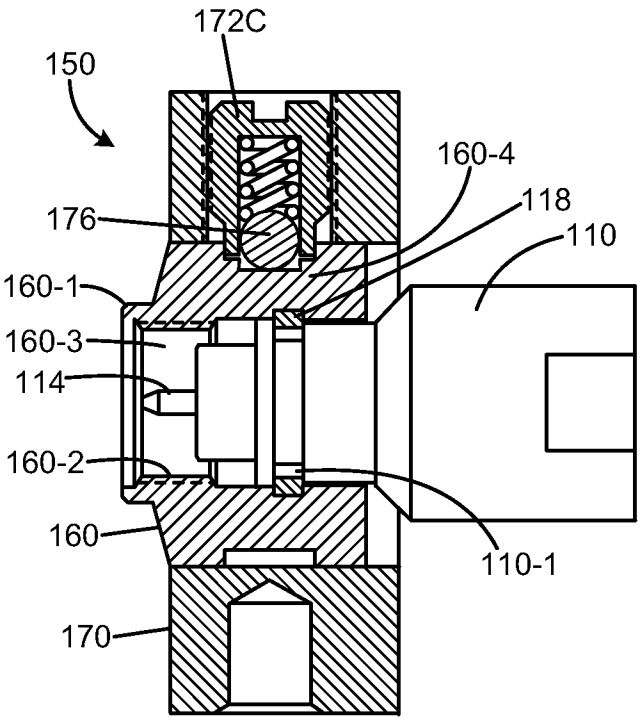
Figure 7B:
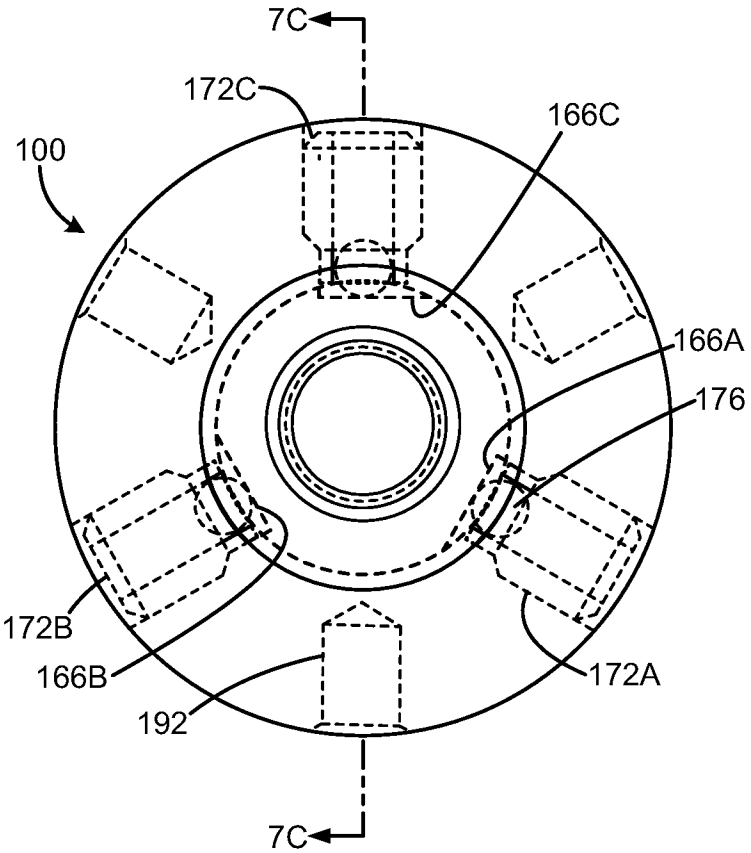

An exemplary embodiment of a torque nut (TN) system 150 is illustrated in FIGS. 7A-7C, wherein the torque nut system is integrated with a male coaxial connector body structure as a non-removable system. As with the torque ring system, the torque nut system includes an inner ring structure 160 and an outer ring structure 170. In this example, the TN system is configured for permanent attachment to the male or hermaphrodite coaxial connector body.

First referring to the isometric view of FIG. 7A, the TN system includes an inner ring structure 160 and an outer ring structure 170. The inner ring structure 160 incorporates the male connector threaded nut structure with nut portion 160-1 and female threaded portion 160-2 formed on the interior surface of the center opening 160-3. The coaxial center conductor pin 114 is also visible in FIG. 7A.

Referring now to FIGS. 7B-7C, the outer ring structure 170 includes the set screw arrangement includes screws 172A, 172B and 172C for applying compression force to balls 176, in a similar manner to that described above for the torque ring system. The inner ring structure includes the interior groove and the indentations (166A, 166B and 166C) formed in the bottom of the groove as with the torque ring system. By adjusting the force applied to the balls by the setscrews, the maximum torque applied by the TN system may be adjusted. The coaxial line elements, including the center conductor, dielectric and outer conductor are not shown in FIG. 7B.

FIG. 7C is a diagrammatic cross-sectional view of the torque system 150 taken along line 7C-7C of FIG. 7B, with the coaxial connector features shown in assembled form. The outer conductor 110 of the male coaxial connector is shown in inserted position into the center opening 160-3 of the inner ring structure 160. A split ring 118 in outer conductor groove 110-1 secures the outer conductor 110 in its inserted position by engagement in groove 160-4 formed in the inner surface of the inner ring structure. The threaded portion 160-2 is configured to engage with the male threads on the female connector body (not shown) of the coaxial connector pair. The TN system 100 operates in a similar manner to that discussed above regarding the torque ring system, except that the TN system 100 is intended to be non-removable with respect to the coaxial line end.

The inner ring can be fabricated of a metallic material for strength and wear characteristics, but does not have to be conductive. The outer ring can be plastic, metal or composite, with the materials selected to be suitable to provide excellent long term wear characteristics.

Figure 8A:
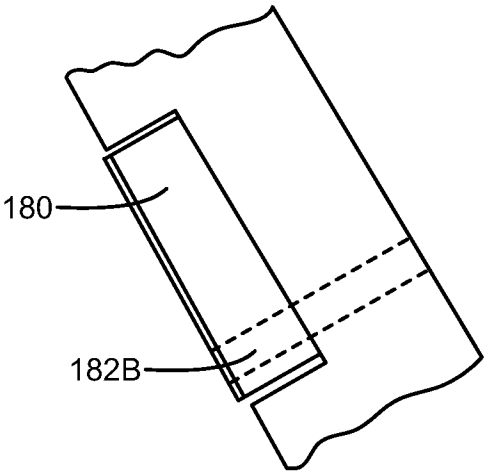
FIGS. 8 and 8A illustrate an alternate embodiment of a torque nut system with swing out pawls to amplify the applied torque.
Figure 8:
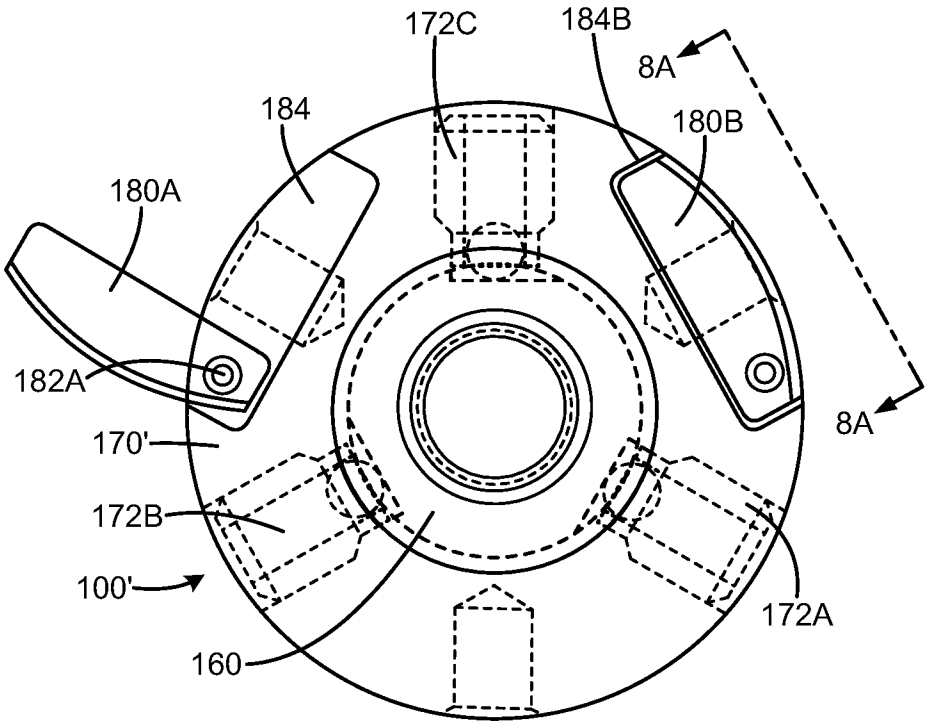

The amount of torque applied by the use to the TR or TN system can be amplified by use of swing out pawls, as illustrated in FIGS. 8A and 8B. In this example, the TR system 100' is similar to system 100 of FIGS. 7A-7C, but includes pawls 180A and 180B mounted to the periphery of the outer ring structure 170' by pivot pins 182. In this example, two pawls are shown. Each pawl is mounted at a peripheral location so as not to interfere with the setscrews 172A, 172B and 172C, and can be pivoted outwardly from a corresponding recess 184A, 184B formed in the periphery of the outer ring (a storage position as shown in FIG. 8A) to a deployed position shown in FIG. 8. The pawls are mounted for pivoting movement in respective opposite senses on the respective pivot 182A, 182B, so that user may push on the deployed pawl 182A to rotate the outer ring in a counterclockwise direction, or to use the pawl 182B to rotate the outer ring in the clockwise direction, facilitating tightening the inner ring 160 and the male connector onto a female connector body, or removing the inner ring and the male connector from a female connector body.

Figure 9A:
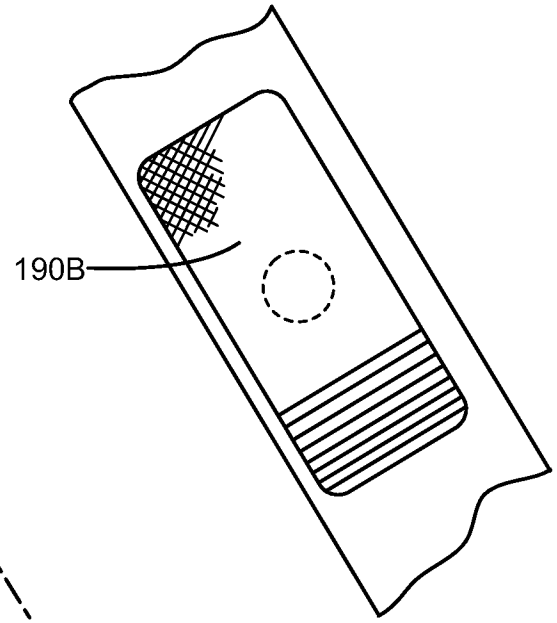
FIGS. 9 and 9A illustrate another alternate embodiment of a torque ring or nut system with grip amplifiers having different textured surfaces.
Figure 9:
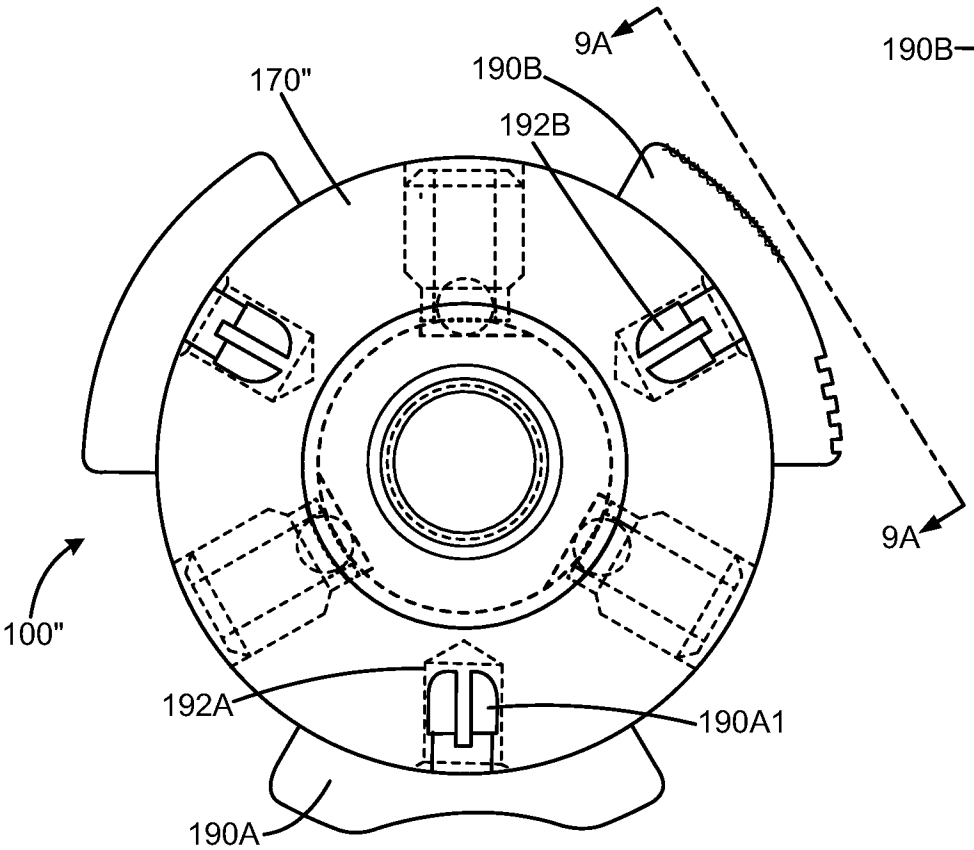

FIGS. 9 and 9A illustrate another grip multiplier device which may be employed to assist the user in tightening or removing a TR or TN system. In this example, grip multipliers 190A and 190B have barb features 192A, 192B which snap into holes 192 formed in the outer periphery of the outer ring structure 70". The grip multipliers may be made of plastic or metal, and may be easily removed. The grip multipliers provide a simple way to increase the effective diameter of the outer ring structure to provide additional grip leverage.

Although the foregoing has been a description and illustration of specific embodiments of the subject matter, various modifications and changes thereto can be made by persons skilled in the art without departing from the scope and spirit of the invention.

What is claimed is:

1. A torque system for use on or with RF and microwave male-female paired coaxial connectors to apply a pre-set torque value to the mated coaxial connector pair, the system comprising:

an inner ring structure configured for connection to or integration with one of the connectors, so that rotation of the inner ring structure causes rotation of internal threads of said one connector;

an outer ring structure, with the outer ring structure configured for rotation about the inner ring structure in response to forces exceeding the pre-set torque value applied by a user and to apply torque to the inner ring structure and thereby rotate the internal threads of said one connector;

the inner ring structure having a continuous groove formed in its outer peripheral surface having a depth configured to receive one or more spring-biased balls into the groove introduced from the outer ring structure, the groove forming a ball race;

the groove having one or more indentations formed in a bottom surface of the ball race defining a ramp surface;

the one or more spring-biased balls further being configured for insertion depth adjustment into the groove to provide adjustment for a maximum torque applied by the outer ring structure to the inner ring structure;

the one or more indentations each allowing one of the one or more spring-biased balls to be received in the one or more indentations, relieving tension on the one or more spring-biased balls, and wherein a maximum torque on the inner ring structure resulting from rotation of the outer ring in a first direction is applied with the one or more balls positioned out of the respective one or more indentations of the groove.

2. The system of claim 1, wherein the inner ring structure has a central opening, with an opening size and configuration to conform closely to a connector size of a connector coupling nut of said one connector, allowing the torque system to be engaged on the connector coupling nut.

3. The system of claim 2, wherein the opening is a hexagonal opening configuration.

4. The system of claim 2, wherein the torque system and inner ring structure are configured for removal from the connector coupling nut after use.

5. The system of claim 2, wherein the inner ring structure further comprises a stop surface to control depth of engagement of the connector coupling nut with the inner ring structure.

6. The system of claim 1, further comprising a respective retaining post device for a respective one of the one or more spring-biased balls to adjustably position the respective spring-biased ball at a depth relative to the groove in a range of depths.

7. The system of claim 6, wherein the retaining post device is a hollow set screw received in a threaded opening in the outer ring structure, the set screw having a spring positioned in a hollow recess and configured to apply a tension force to the respective ball.

8. The system of claim 1, wherein:

the indentation is further defined by a stop surface at an angle relative to the ramp surface;

maximum torque is reached when the ball travels to an edge of the ramp surface of the indentation and transitions to the surface of the inner ring groove as the outer ring structure is rotated in the first direction over the fixed or stationary inner ring structure, and the maximum torque cannot be exceeded even as the outer ring continues through 360 degrees of continuous rotation in a first direction;

as the outer ring structure is rotated in the first direction, the one or more balls will drop into the indentation, with the ball being adjacent to the stop surface of the indentation, and rotation of the outer ring in a second direction opposite the first direction presents a higher torque value by the ball seeking to climb over the stop surface, this higher torque value applied to the inner ring structure and transmitted to the connector nut, allowing the user to overcome the torque applied to mate the connector pair and therefore allowing the mated pair of connectors to be unthreaded and decoupled.

9. The system of claim 1, further comprising a force amplifying device attached to the outer ring structure for amplifying a force applied to the outer ring structure by a user.

10. The from an system of claim 9, wherein the force amplifying device includes an auxiliary rod protruding outer surface of the outer ring structure.

11. The system of claim 9, wherein the force amplifying device includes a first swing-out pawl.

12. The system of claim 11, wherein the force amplifying device includes a second swing-out pawl, and wherein the first and second swing-out pawls are mounted for pivoting movement in respective opposite senses on respective pivot points to respective deployed positions, so that a user may push on the deployed first pawl to rotate the outer ring structure in a counterclockwise direction, or to push on the deployed second pawl to rotate the outer ring structure in the clockwise direction.

13. The system of claim 9, wherein the force amplifying device includes at least two grip multipliers each having a feature which engages a hole formed in the outer periphery of the outer ring structure.

14. The system of claim 1, wherein:

the inner ring structure including a central opening;

the coupling nut is formed integrally with the inner ring structure by a set of female threads formed on an interior surface of the central opening.

15. The system of claim 14, wherein the inner ring structure is further configured to receive and captivate an end portion of an outer conductor of said one connector within the central opening.

16. The system of claim 1, wherein said maximum torque on the inner ring structure resulting from rotation of the outer ring in a first direction is in a range of 5 to 25 inch pounds of torque.

17. The system of claim 16, wherein said maximum torque is about 8 inch pounds of torque.

18. A torque ring system for use on or with RF and microwave male-female paired coaxial connectors in which the male connector includes a connector coupling nut with internal theads, to apply torque to the mated coaxial connector pair, the system comprising:

an inner ring structure configured for connection to the connector coupling nut of the male connector, so that rotation of the inner ring structure causes rotation of the connector coupling nut;

an outer ring structure in axial alignment with the inner ring structure and coupled to the inner ring structure in a generally concentric arrangement and configured to apply torque to the inner ring structure and thereby rotate the coupling nut of the male connector, the outer ring structure configured for rotation about the inner ring structure in response to forces applied by a user exceeding a maximum torque value;

a plurality of balls;

the inner ring structure having a continuous circumferential groove formed in an outer peripheral surface having a depth configured to receive the plurality of balls into the groove introduced from the outer ring structure, the groove forming a ball race;

the groove having a plurality of indentations formed in a bottom surface of the ball race, each indentation defining a ramp surface;

a respective biasing device for each of said plurality of balls to adjustably position the respective ball at a depth relative to the groove in a range of insertion depths, the respective biasing device configured to apply a biasing force to the ball, the insertion depth adjustment into the groove providing adjustment for a maximum torque applied by the outer ring structure to the inner ring structure;

the respective biasing device having a distal end received within the groove and configured to allow rotation of the outer ring structure relative to the inner ring structure, the distal end received within the groove further serving to maintain axial alignment of the inner and outer ring structures;

the indentation allowing the ball to be received in the indentation, relieving tension on the ball, and wherein maximum torque on the inner ring structure due to rotation of the outer ring in a first direction is applied with the ball positioned out of the indentation of the groove.

19. The system of claim 18, wherein each respective biasing device includes a hollow set screw received in a threaded opening in the outer ring structure, the set screw having a spring positioned in a hollow recess and configured to apply the biasing force to the respective ball.

20. The system of claim 18, wherein the inner ring structure has a central opening, with an opening size and configuration to conform closely to a connector size of the male connector coupling nut to be threaded and torqued to specification, allowing the torque system to be engaged on the connector coupling nut.

21. The system of claim 18, wherein the torque system and inner ring structure are configured for removal from the connector coupling nut after use.

22. The system of claim 18, wherein:

the indentation is further defined by a stop surface at an angle relative to the ramp surface;

maximum torque is reached when the ball travels to an edge of the ramp surface of the indentation and transitions to the surface of the inner ring groove as the outer ring structure is rotated in the first direction over the inner ring, and the maximum torque cannot be exceeded even as the outer ring continues through 360 degrees of continuous rotation in the first direction;

as the outer ring structure is rotated in the first direction, the ball will drop into the indentation, with the ball being adjacent to the stop surface of the indentation, and rotation of the outer ring in a second direction opposite the first direction presents a higher torque value by the ball seeking to climb over the stop surface, this higher torque value applied to the inner ring structure and transmitted to the connector nut, allowing the user to overcome the torque applied to mate the connector pair and therefore allowing the mated pair of connectors to be unthreaded and decoupled.

23. The system of claim 18, further comprising a force amplifying device attached to the outer ring structure for amplifying a force applied to the outer ring structure by a user.

24. The system of claim 18, wherein said plurality of balls is at least three balls, and said biasing devices are radially arranged in equally spaced relation in radial through openings formed through the outer ring structure.

25. The system of claim 19, wherein each said hollow set screw is configured for manual adjustment within the threaded opening to adjust the biasing force and said maximum torque without disassembly of the outer ring structure from the inner ring structure.

26. A torque nut system for RF and microwave male-female paired coaxial connectors, the torque system configured to apply torque to the mated coaxial connector pair, the paired coaxial connectors including a coupling nut with female threads on a first one of the connectors and an external thread set on a second one of the connectors, the torque nut system comprising:

an inner ring structure configured for connection to a connector body of the first one of the connectors, the inner ring structure including a central opening;

the coupling nut is formed integrally with the inner ring structure by a set of female threads formed on an interior surface of the central opening so that rotation of the inner ring structure causes rotation of the female threads;

an outer ring structure in axial alignment with the inner ring structure and coupled to the inner ring structure in a generally concentric arrangement and configured to apply torque to the inner ring structure and thereby rotate the inner ring, with the outer ring structure configured for rotation about the inner ring structure in response to forces applied by a user exceeding a maximum torque value;

the inner ring structure having a continuous circumferential groove formed in an outer peripheral surface having a depth configured to receive a ball into the groove introduced from the outer ring structure, the groove forming a ball race extending completely around the outer peripheral surface;

the groove having an indentation formed in a bottom surface of the ball race defining a ramp surface;

a threaded member received in a threaded opening in the outer ring structure and having a distal end, the threaded member configured to position the distal end within the groove formed in the inner ring structure to maintain axial alignment of the inner ring structure and the outer ring structure, the threaded member further arranged to contact the ball to adjustably position the ball at a depth relative to the groove in a range of insertion depths by rotating the threaded member in the threaded opening, the threaded member including a biasing device to apply a biasing force to the ball, the insertion depth adjustment into the groove providing adjustment for a maximum torque applied by the outer ring structure to the inner ring structure in a first rotational direction without disassembly of the outer ring structure from the inner ring structure;

the indentation allowing the ball to be received in the indentation, relieving tension on the ball, and wherein maximum torque on the inner ring structure is applied with the ball positioned out of the indentation of the groove.

27. The system of claim 26, wherein the inner ring structure is further configured to receive and captivate an end portion of an outer conductor of the male connector within the central opening.

28. The system of claim 26, wherein the threaded member is a hollow set screw received in a threaded opening in the outer ring structure, the set screw having a spring positioned in a hollow recess and configured to apply the biasing force to the ball.

29. A torque system for use on or with RF and microwave male-female paired coaxial connectors to apply a pre-set torque value to the mated coaxial connector pair, the system comprising:

an inner ring structure configured for connection to or integration with one of the connectors, so that rotation of the inner ring structure causes rotation of internal threads of said one connector;

an outer ring structure in axial alignment with the inner ring structure, with the outer ring structure configured for rotation about the inner ring structure in response to forces exceeding the pre-set torque value applied by a user and to apply torque to the inner ring structure and thereby rotate the internal threads of said one connector;

the inner ring structure having a continuous circumferential groove formed in an outer peripheral surface having a depth configured to receive one or more spring-biased balls into the groove introduced from the outer ring structure, the groove forming a ball race extending completely about the outer peripheral surface;

the groove having one or more indentations formed in a bottom surface of the ball race defining a ramp surface;

each of the one or more spring-biased balls further being configured for insertion depth adjustment into the groove by a respective retaining post member mounted in the outer ring structure to provide adjustment for a maximum torque applied by the outer ring structure to the inner ring structure;

the respective retaining post member having a distal end received within the groove and configured to allow relative rotation of the outer ring structure relative to the inner ring structure while securing the inner ring structure in axial alignment with the outer ring structure;

the one or more indentations each allowing one of the one or more spring-biased balls to be received in the one or more indentations, relieving tension on the one or more spring-biased balls, and wherein a maximum torque on the inner ring structure resulting from rotation of the outer ring in a first direction is applied with the one or more balls positioned out of the respective one or more indentations of the groove.

* * * * *